US007547087B2

(12) United States Patent
Cato et al.

(10) Patent No.: US 7,547,087 B2
(45) Date of Patent: Jun. 16, 2009

(54) FAULT DETECTION CIRCUIT FOR PRINTERS WITH MULTIPLE PRINT HEADS

(75) Inventors: Robert T. Cato, Raleigh, NC (US); Timothy W. Crocket, Raleigh, NC (US); Charles R. Kirk, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 296 days.

(21) Appl. No.: 11/678,288

(22) Filed: Feb. 23, 2007

(65) Prior Publication Data

US 2008/0204035 A1 Aug. 28, 2008

(51) Int. Cl.
*B41J 29/393* (2006.01)

(52) U.S. Cl. ..... 347/19

(58) Field of Classification Search ..... 347/19; 219/216, 482, 506; 324/322, 522, 525, 549
See application file for complete search history.

(56) References Cited

U.S. PATENT DOCUMENTS 4,500,893 A * 2/1985 Sakura et al. ..... 347/211
4,595,935 A * 6/1986 Brooks et al. ..... 347/171
4,769,657 A 9/1988 Takahashi
4,774,526 A 9/1988 Ito
6,760,053 B2 7/2004 Rother

* cited by examiner

*Primary Examiner*—Lamson D Nguyen
(74) *Attorney, Agent, or Firm*—Cantor Colburn LLP; Jason Piche

(57) ABSTRACT

A fault detector apparatus for a printer having a first print head and a second print head with a plurality of print head elements in each print head is disclosed. The apparatus includes a test circuit in signal communication with all the print heads to test the plurality of print head elements. The test circuit includes a test power supply for generating a test voltage, a first resistor, a second resistor, and an analog to digital converter in signal communication with the second resistor. The first resistor is in series connection between the test power supply and the plurality of elements in the first print head. The second resistor in series connection with the test power supply, the first resistor, and the plurality of elements in the second print head. The fault detector apparatus will also work for a printer with only one print head.

13 Claims, 2 Drawing Sheets

Test
66

50
70
74
62
0
110
116
120
132
PROCESSOR
A/D
124
128
104
152
160
112
24V
24V
148
100
144
144
80
80
54
58
156
156
108
To Processor
110
0
0
To Processor
110
To Processor
110
To Processor
110
0
0

FAULT DETECTION CIRCUIT FOR PRINTERS WITH MULTIPLE PRINT HEADS

TRADEMARKS

IBM® is a registered trademark of International Business Machines Corporation, Armonk, N.Y., U.S.A. Other names used herein may be registered trademarks, trademarks or product names of International Business Machines Corporation or other companies.

BACKGROUND OF THE INVENTION

1. Field of the Invention

This invention relates to printers, and particularly to testing of printers having multiple print heads.

2. Description of Background

Some point of sale printers use more than one printing technology, such as to print sales receipts via a thermal print head and print upon checks a summary journal via an impact print head. When an element fails in either the thermal or impact print heads, the problem is often not detected until after many receipts or checks are printed. Fault detection circuits contemplated for thermal print heads utilize operational amplifier components that add significantly to the circuit cost, but do not detect failure of integrated impact print heads. Accordingly, there is a need in the art for a fault detector arrangement that overcomes these drawbacks.

SUMMARY OF THE INVENTION

The shortcomings of the prior art are overcome and additional advantages are provided through the provision of a single fault detection circuit that detects faults in multiple print heads of a printer.

An embodiment of the invention provides a fault detector apparatus for a printer having a first print head and a second print head with a plurality of print head elements in each print head. The apparatus includes a test circuit in signal communication with all the print heads to test the plurality of print head elements. The test circuit includes a test power supply for generating a test voltage, a first resistor, a second resistor, and an analog to digital converter in signal communication with the second resistor. The first resistor is in series connection between the test power supply and the plurality of elements in the first print head. The second resistor is in series connection with the test power supply, the first resistor, and the plurality of elements in the second print head.

In response to a flow of current from the test power supply through the first resistor and one of the plurality of elements in the first print head, the analog to digital converter detects a first voltage. If the one element in the first print head is operating in accordance with an acceptable operational characteristic, the first voltage is described by:

$$\frac{res116}{res116 + element1}(v66).$$

In response to a flow of current from the test power supply through the first and second resistors and one of the plurality of elements in the second print head, the analog to digital converter detects a second voltage. If the one element in the second print head is operating in accordance with an acceptable operational characteristic, the second voltage is described by:

$$\frac{res116 + res132}{res116 + res132 + element2}(v66),$$

where:

v66 represents the test voltage;

res116 represents a resistance of the first resistor;

res132 represents a resistance of the second resistor;

element1 represents a resistance of the properly operating element in the first print head; and element2 represents a resistance of the properly operating element in the second print head.

Another embodiment of the invention provides a fault detector apparatus for a printer having an impact print head with a plurality of electromagnetic coils and a thermal print head with a plurality of heating elements. The apparatus includes a test circuit in signal communication with the impact print head and the thermal print head to test the plurality of electromagnetic coils and the plurality of heating elements. The test circuit includes a test power supply for generating a test voltage, a first resistor, a second resistor, and an analog to digital converter in signal communication with the second resistor. The first resistor is in series connection between the test power supply and the plurality of electromagnetic coils. The second resistor is in series connection with the test power supply, the first resistor, and the plurality of heating elements.

In response to a flow of current from the test power supply through the first resistor and one of the plurality of electromagnetic coils, the analog to digital converter detects a first voltage. If the one electromagnetic coil is operating in accordance with an acceptable operational characteristic, the first voltage is described by:

$$\frac{res116}{res116 + element1}(v66).$$

In response to a flow of current from the test power supply through the first and second resistors and one of the plurality of heating elements, the analog to digital converter detects a second voltage. If the one heating element operating in accordance with an acceptable operational characteristic, the second voltage is described by:

$$\frac{res116 + res1322}{res116 + res132 + element2}(v66),$$

where:

v66 represents the test voltage;

res116 represents a resistance of the first resistor;

res132 represents a resistance of the second resistor;

element1 represents a resistance of the properly operating electromagnetic coil; and element2 represents a resistance of the properly operating heating element.

Another embodiment of the invention provides a fault detector apparatus for a printer having an impact print head with a plurality of electromagnetic coils and a thermal print head with a plurality of heating elements. The apparatus includes a test circuit in signal communication with the impact print head and the thermal print head to test the plurality of electromagnetic coils and the plurality of heating elements. The test circuit includes a test power supply for generating a test voltage, a first resistor, a second resistor, an analog to digital converter in signal communication with the second resistor, and a processor in signal communication with the analog to digital converter.

The first resistor is in series connection between the test power supply and the plurality of electromagnetic coils and has a resistance about equal to a resistance of one of the plurality of electromagnetic coils operating in accordance with an acceptable operational characteristic. The second resistor is in series connection with the test power supply, the first resistor, and the plurality of heating elements. The first resistor and second resistor have a combined resistance about equal to a resistance of one of the plurality of heating elements operating in accordance with an acceptable operational characteristic.

In response to a flow of current from the test power supply through the first resistor and one of the plurality of electromagnetic coils, the analog to digital converter detects a first voltage. The processor is receptive of a signal representative of the first voltage detected by the analog to digital converter, and responsive to generate a notification signal if the detected first voltage deviates beyond a threshold from about half of the test voltage.

In response to a flow of current from the test power supply through the first and second resistors and one of the plurality of heating elements, the analog to digital converter detects a second voltage. The processor is receptive of a signal representative of the second voltage detected by the analog to digital converter, and responsive to generate a notification signal if the detected second voltage deviates beyond a threshold from about half of the test voltage Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

An embodiment of the invention provides a circuit that will characterize the thermal and impact print head elements and notify appropriate personnel or software that the print head requires service or has limited function. One embodiment will utilize a single voltage divider network to test both the impact print head elements and the thermal print head elements. It should be noted that the apparatus described herein may also be applicable to other types of print heads such as ink jet.

The circuit to characterize the print heads uses a small amount of electrical current from a low voltage source to measure the resistance of each element (such as an electromagnetic coil and control switch, or heating element and control switch, for example) in each print head, one element at a time, when normal printing is not being done. Making these measurements does not cause printing.

Figure 1:
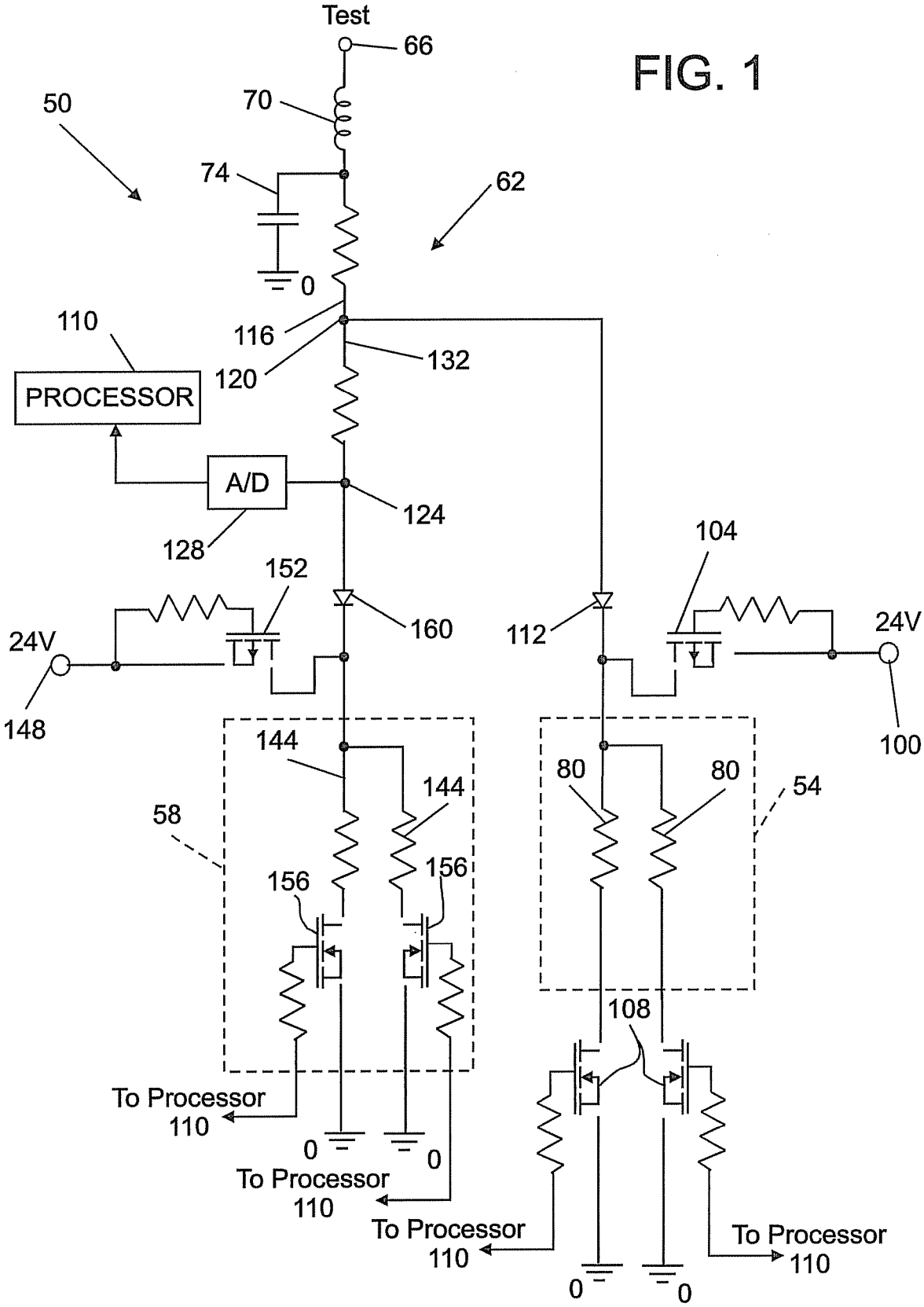
FIG. 1 illustrates one example of a schematic fault detection circuit.

Turning now to the drawings in greater detail, it will be seen that in FIG. 1 there is an exemplary embodiment of a fault detector apparatus 50 for a printer having an impact print head (represented schematically in FIG. 1 by reference numeral 54) and a thermal print head (represented schematically in FIG. 1 by reference numeral 58). The fault detector apparatus 50 includes a test circuit 62 in signal communication with the impact print head 54 and the thermal print head 58. The test circuit 62 utilizes power supply 66, also herein referred to as a 'test power supply'. In one exemplary embodiment, the test circuit further includes an inductor 70 and a capacitor 74 to protect the power supply 66 from voltage and current spikes generated as a result of operating and testing the print heads 54, 58, as will be described further below.

Figure 2:
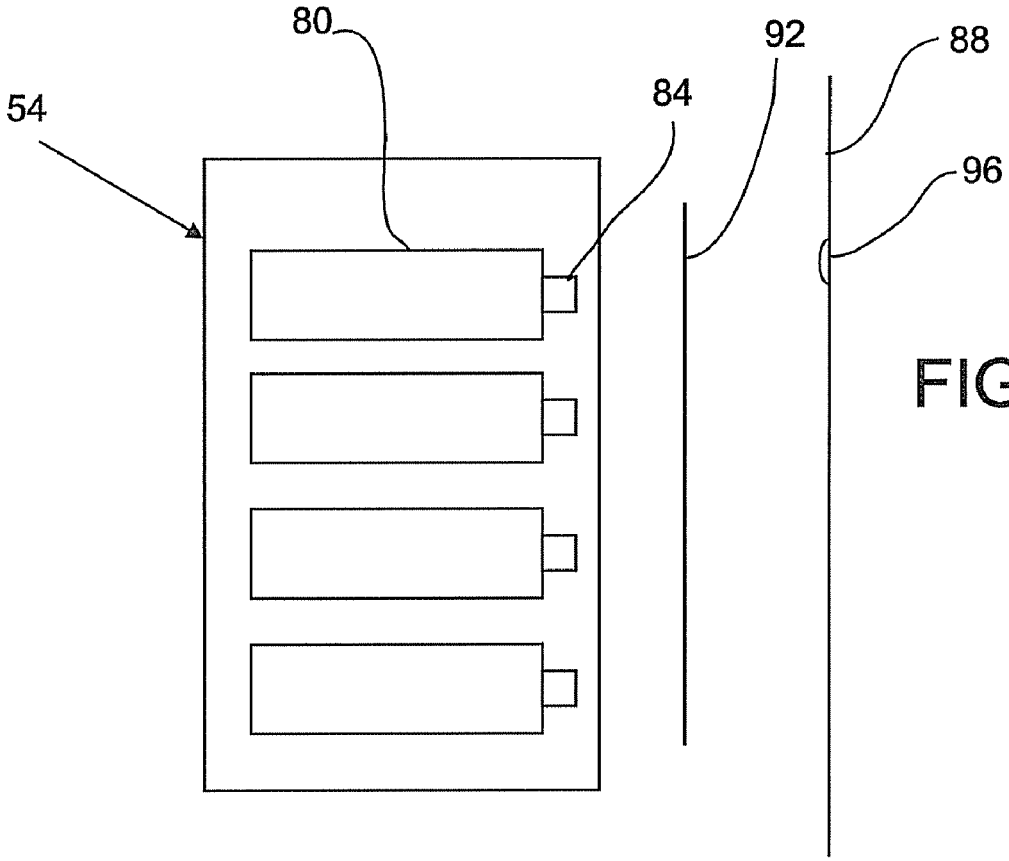
FIG. 2 illustrates one example of an impact print head.

Referring now to FIG. 2, a schematic view of the impact print head 54 is depicted. The impact print head 54 includes a plurality of electromagnetic coils 80, which when energized, cause a steel pin 84 to project onto ribbon 92, which is pushed against a piece of paper 88, thereby printing a dot 96 on the paper 88. Referring back now to FIG. 1, two electromagnetic coils 80 are each represented schematically by resistors 80. It will be appreciated that representation of the electromagnetic coils 80 by resistors 80 represent two of the plurality of electromagnetic coils 80 for clarity of illustration only, and that the print head 54 may include more than two of the plurality of electromagnetic coils 80. Further, the electromagnetic coil 80 may possess other electrical characteristics, such as inductance, for example.

A first power supply 100 is in power connection with, and provides operational power to the plurality of electromagnetic coils 80. An exemplary embodiment will use the first power supply 100 capable of generating 24 volts of operational power. A first power switch 104, such as a p-type enhancement MOSFET is in series connection between the first power supply 100 and the plurality of electromagnetic coils 80. In normal operation, the power switch 104 is closed to provide power to the plurality of electromagnetic coils 80. Each electromagnetic coil 80 is in signal communication with a control switch 108, such as an n-type enhancement MOSFET. Each control switch 108 activates each electromagnetic coil 80 in response to a controller, such as a processor 110 to produce the desired dots 96. One embodiment will include a first diode 112 in series connection between the power supply 100 and a first resistor 116 to isolate and protect the power supply 66 of the test circuit 62 from the voltage generated by the first power supply 100.

Faults within the electromagnetic coil 80, such as a short circuit, or an open circuit, will prevent proper operation of the electromagnetic coil 80 to produce the desired dots 96. Accordingly, the test circuit 62 will test a condition of each of the plurality of electromagnetic coils 80 and control switches 108 to determine if there are any faults that may cause the print head 54 to operate in an unexpected maimer.

During testing, the power switch 104 is opened to remove operational power from the print head 54. The power supply 66 and one control switch 108 (corresponding to one electromagnetic coil 80 of the plurality) will be activated. Accordingly, current will flow from the power supply 66 through a first resistor 116 in series collection between the power supply 66 and the electromagnetic coil 80 to the corresponding control switch 108. This will be repeated for each electromagnetic coil 80 of the plurality.

For the above described current flow circuit, it will be appreciated that a voltage at a node 124 will be equal to a voltage at a node 120 if no (or negligible) current flows through a second resistor 132. An analog to digital converter 128 in signal communication with resistor 132 at the node 124, detects, or samples a plurality of voltages at the node 124 that correspond to the testing of each of the plurality of electromagnetic coils 80. The analog to digital converter 128 provides a plurality of signals, which represent each of the plurality of detected voltages, to the processor 110, which compares the signals corresponding to the detected voltages to an expected voltage to determine if the print head 54 requires service or has limited function, as will be described further below.

In response to the flow of current from power supply 66 through the first resistor 116 and a properly operating electromagnetic coil 80, (also herein referred to as an electromagnetic coil "operating in accordance with an acceptable operational characteristic") the analog to digital converter 128 detects a first voltage at the node 124 described by:

$$\frac{res116}{res116 + element1}(v66),$$

where v66 represents the test voltage provided by power supply 66, res116 represents a resistance of the first resistor 116, and element1 represents a resistance of the properly operating electromagnetic coil 80.

However, if the electromagnetic coil 80 includes a fault, such as a short circuit or an open circuit, for example, the signal representing the first voltage detected by the analog to digital converter 128 and provided to the processor 110 will deviate, or vary from that expected and described above in response to the properly operating electromagnetic coil 80. The above assumes that the voltage drop across isolation inductor 70 and isolation diode 112 are either negligible or constant or both. The above also assumes that the voltage drop across control switch 108 is negligible when it is on and working properly.

One embodiment utilizes a test voltage within the test circuit 62 generated by the power supply 66 at one of about 3.3 volts and 5.0 volts. Use of the test voltage at one of 3.3 volts and 5.0 volts within the test circuit 62 matches the logic voltage that the analog to digital converter 128 utilizes, and thereby avoids the use of an expensive operational amplifier component. Furthermore, use of the test voltage at one of 3.3 volts and 5.0 volts within the test circuit 62 is low enough to avoid causing the pin 84 to project onto the ribbon 92 and paper 88, and thereby avoids any additional wear of the pin 84.

Figure 3:
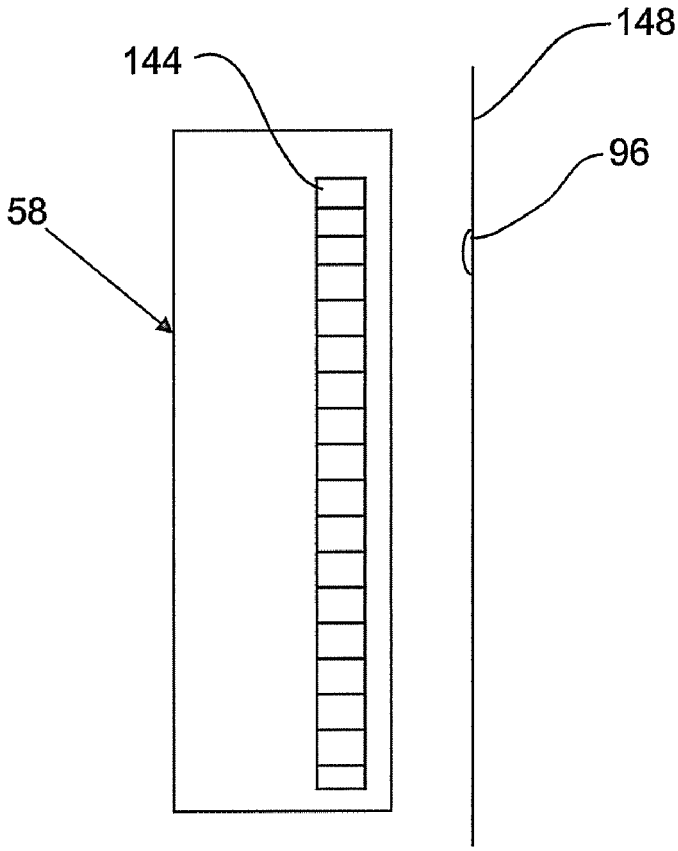
FIG. 3 illustrates one example of a thermal print head.

Referring now to FIG. 3, a schematic view of the thermal print head 58 is depicted. The thermal print head 58 includes a plurality of heating elements 144, which when energized, increase in temperature, and cause a change in a temperature sensitive paper 148, thereby printing the dot 96 on the paper 148 corresponding to a location of the energized heating element 144. Referring back now to FIG. 1, two heating elements 144 are each represented schematically by resistors 144. It will be appreciated that representation of the heating elements 144 by resistors represents two of the plurality of heating elements 144 for clarity of illustration only, and that the print head 58 may include more than two of the plurality of heating elements 144. Furthermore, the heating element 144 may possess other electrical characteristics, such as inductance, for example.

A second power supply 148 is in signal communication with, and provides operational power to, the plurality of heating elements 144. An exemplary embodiment will use the second power supply 148 capable of generating 24 volts of operational power. A second power switch 152, such as a p-type enhancement MOSFET, is in series connection between the second power supply 148 and the plurality of heating elements 144. In normal operation, the power switch 152 is closed to provide power to the plurality of heating elements 144. Each heating element 144 is in signal communication with a control switch 156, such as an n-type enhancement MOSFET. The control switch 156 activates each heating element 144 in response to the processor 110 to produce the desired dots 96. One embodiment will include a second diode 160 in series connection between the second power supply 148 and the second resistor 132 to isolate and protect the power supply 66 from voltage generated by the second power supply 148.

One embodiment of the thermal print head 58 uses heating elements 144 that include thin film carbon resistors, which often exhibit repeatable behavior over time. That is, as damage to the thin film carbon resistors accumulates, the resistance increases until the heating element 144 represents an open circuit. Accordingly, the test circuit 62 will test a condition of each of the plurality of heating elements 144 to determine if there are any faults that may cause the print head 58 to operate in an unexpected manner, such as failure to produce the desired dots 96. Unexpected operation can include degraded operation due to increased heating element resistance as well as failing to operate due to a heating element being an open circuit.

During testing, the power switch 152 is opened to remove operational power from the print head 58. The power supply 66 and one control switch 156 (corresponding to one heating element 144 of the plurality) will be activated. Accordingly, current will flow from the power supply 66 through the first resistor 116 and the second resistor 132 in series communication with the heating element 144, to the corresponding control switch 156. This will be repeated for each heating element 144 of the plurality of heating elements 144. The analog to digital converter 128 in signal communication with the second resistor 132 at the node 124, detects, or samples a plurality of voltages at the node 124 that correspond to the testing of each of the plurality of heating elements 144. The analog to digital converter 128 provides a plurality of signals, which represent each of the plurality of detected voltages, to the processor 110, which compares the signals corresponding to the detected voltages to an expected voltage to determine if the print head 58 requires service or has limited function.

In response to the flow of current from the power supply 66 through the first resistor 116, the second resistor 132, a properly operating heating element 144, (also herein referred to as a heating element "operating in accordance with an acceptable operational characteristic"), and control switch 156, the analog to digital converter 128 detects a second voltage at the node 124, subsequent to the second resistor 132 described by:

$$\frac{res116 + res132}{res116 + res132 + element2}(v66),$$

where v66 represents the test voltage provided by the power supply 66, res116 represents a resistance of the first resistor 116, res132 represents a resistance of the second resistor 132, and element2 represents a resistance of the properly operating heating element 144. However, if the heating element 144 includes a fault, such as an increased resistance, for example, the signal representing the second voltage detected by the analog to digital converter 128 and provided to the processor 110 will deviate, or vary from that expected and described above in response to the properly operating heating element 144.

The processor 110 is receptive of the signal, provided by the analog to digital converter 128 that is representative of at least one of the first voltage and the second voltage detected by the analog to digital converter 128. Further, the processor 110 is responsive to generate a notification signal if the signal representing either the first voltage or the second voltage detected by the analog to digital converter 128 deviate from the value expected in conjunction with either the properly operating electromagnetic coil 80 or the properly operating heating element 144. The notification signal thereby indicates that at least one of the impact print head 54 and the thermal print head 58 require service or has limited function. As used herein, the term "deviate from" indicates a signal that represents a detected voltage that varies from the expected voltage by an amount greater than a threshold within which either the impact print head 54 or the thermal print head 58 have been determined to function as expected.

In an embodiment in which the heating elements 144 of the thermal print heads 58 include carbon film resistors, it is possible to characterize a condition of the heating elements based upon a trend of the signal representing the detected second voltage. Accordingly, the processor 110 employs an algorithm, based upon a trend of change over time of the signal representing the detected second voltage, to predict a service need or a need to compensate for the deviation and generate the notification signal to service the thermal print head 58 or to compensate for the deviation of the change in resistance of the heating element 144 of the thermal print head 58 prior to the detection of a fault. The processor 110 can, for example, perform said compensation by employing an algorithm to adaptively adjust power densities, such as a duration of time that the control switch 156 shall remain closed, based upon a measured trend in the signal representative of the detected second voltage.

In an exemplary embodiment, the first resistor 116 has a resistance value about equal to the resistance of the properly operating electromagnetic coil 80, and the first resistor 116 and the second resistor 132 have a combined resistance about equal to the resistance of the properly operating heating element 144. As used herein, the term "about" shall represent a deviation from a theoretical target that results from tolerances related to design, manufacturing, and changes that result from operation, while still providing acceptable functional results, such as printing the dots 96 on the paper 88, 148 as expected. For example, deviations up to 15% from the theoretical target have been observed in print heads 54, 58 that continue to provide acceptable functional results. In response to the flow of current from the power supply 66 through the first resistor 116 and the properly operating electromagnetic coil 8 and the control switch 108, the analog to digital converter 128 detects the first voltage equal to about half of the test voltage provided by the power supply 66. Likewise, in response to the flow of current from the power supply 66 through the first 116 and second 132 resistors and the properly operating heating element 144 and the control switch 156, the analog to digital converter 128 detects the second voltage equal to about half of the test voltage provided by the power supply 66. Use of such a configuration provides the expected first voltage in response to testing of the properly operating electromagnetic coil 80 equal to the expected second voltage in response to testing of the properly operating heating element 144. This can simplify the determination by the processor 110 whether a service of either of the print heads 54, 58 is required.

The capabilities of the present invention can be implemented in software, firmware, hardware or some combination thereof.

As one example, one or more aspects of the present invention can be included in an article of manufacture (e.g., one or more computer program products) having, for instance, computer usable media. The media has embodied therein, for instance, computer readable program code means for providing and facilitating the capabilities of the present invention. The article of manufacture can be included as a part of a computer system or sold separately.

Additionally, at least one program storage device readable by a machine, tangibly embodying at least one program of instructions executable by the machine to perform the capabilities of the present invention can be provided.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A fault detector apparatus for a printer having a first print head and a second print head with a plurality of print head elements in each print head, the apparatus comprising:

a test circuit in signal communication with all the print heads to test the plurality of print head elements, the test circuit comprising:

a test power supply for generating a test voltage;

a first resistor in series connection between the test power supply and the plurality of elements in the first print head;

a second resistor, the first resistor and the second resistor in series connection with the test power supply and the plurality of elements in the second print head; and an analog to digital converter in signal communication with the second resistor;

wherein in response to a flow of current from the test power supply through the first resistor and one of the plurality of elements in the first print head, the analog to digital converter detects a first voltage; and wherein in response to a flow of current from the test power supply through the first and second resistors and one of the plurality of elements in the second print head, the analog to digital converter detects a second voltage;

wherein in response to a flow of current through the one element in the first print head operating in accordance with an acceptable operational characteristic, the first voltage is described by:

$$\frac{res116}{res116 + element1}(v66);\text{ and}$$

wherein in response to a flow of current through the one element in the second print head operating in accordance with an acceptable operational characteristic, the second voltage is described by:

$$\frac{res116 + res132}{res116 + res132 + element2}(v66)$$

where:

v66 represents the test voltage;

res116 represents a resistance of the first resistor;

res132 represents a resistance of the second resistor;

element1 represents a resistance of the properly operating element in the first print head; and element2 represents a resistance of the properly operating element in the second print head.

2. The apparatus of claim 1, wherein:

the printer comprises one print head.

3. The apparatus of claim 1, wherein:

the first print head is an impact print head comprising a plurality of electromagnetic coils; and the second print head is a thermal print head comprising a plurality of heating elements.

4. The apparatus of claim 1, wherein:

the first resistor has a resistance about equal to the resistance of the one element in the first print head operating in accordance with an acceptable operational characteristic;

the first resistor and the second resistor have a combined resistance about equal to the resistance of the one element in the second print head operating in accordance with an acceptable operational characteristic;

in response to the flow of current from the test power supply through the first resistor and the one element in the first print head operating in accordance with an acceptable operational characteristic, the analog to digital converter detects the first voltage equal to about half of the test voltage; and in response to the flow of current from the test power supply through the first and second resistors and the one element in the second print head operating in accordance with an acceptable operational characteristic, the analog to digital converter detects the second voltage equal to about half of the test voltage.

5. The apparatus of claim 1, further comprising:

a first power supply in power connection with the plurality of elements in the first print head;

a second power supply in power connection with the plurality of elements in the second print head;

a first power switch in series connection between the first power supply and the plurality of elements in the first print head; and a second power switch in series connection between the second power supply and the plurality of elements in the second print head;

wherein the first power switch is opened prior to the flow of current from the test power supply through the first resistor and the element in the first print head; and wherein the second power switch is opened prior to the flow of current from the test power supply through the first resistor, the second resistor, and the element in the second print head.

6. The apparatus of claim 5, further comprising:

a first diode in series connection between the first power supply and the first resistor to isolate the test power supply from the first power supply; and a second diode in series connection between the second power supply and the second resistor to isolate the test power supply from the second power supply.

7. The apparatus of claim 1, further comprising:

a processor in signal communication with the analog to digital converter;

wherein the processor is receptive of a signal representative of the first voltage detected by the analog to digital converter, and responsive to generate a notification signal if the detected first voltage deviates beyond a threshold from the first voltage described by:

$$\frac{res116}{res116 + element1}(v66); \text{ and}$$

wherein the processor is receptive of a signal representative of the second voltage detected by the analog to digital converter, and responsive to generate a notification signal if the detected second voltage deviates beyond a threshold from the second voltage described by:

$$\frac{res116 + res132}{res116 + res132 + element2}(v66).$$

8. The apparatus of claim 7, wherein:

the processor generates the notification signal based upon a trend of change of the signal representative of the second voltage.

9. The apparatus in claim 1 wherein one of the print heads has only one print head element.

10. A fault detector apparatus for a printer having an impact print head with a plurality of electromagnetic coils and a thermal print head with a plurality of heating elements, the apparatus comprising:

a test circuit in signal communication with the impact print head and the thermal print head to test the plurality of electromagnetic coils and the plurality of heating elements, the test circuit comprising:

a test power supply for generating a test voltage;

a first resistor in series connection between the test power supply and the plurality of electromagnetic coils, the first resistor having a resistance about equal to a resistance of one of the plurality of electromagnetic coils operating in accordance with an acceptable operational characteristic;

a second resistor, the first resistor and the second resistor in series connection with the test power supply and the plurality of heating elements, the first resistor and second resistor having a combined resistance about equal to a resistance of one of the plurality of heating elements operating in accordance with an acceptable operational characteristic;

an analog to digital converter in signal communication with the second resistor; and a processor in signal communication with the analog to digital converter;

wherein in response to a flow of current from the test power supply through the first resistor and one of the plurality of electromagnetic coils, the analog to digital converter detects a first voltage;

wherein in response to a flow of current from the test power supply through the first and second resistors and one of the plurality of heating elements, the analog to digital converter detects a second voltage;

wherein the processor is receptive of a signal representative of the first voltage detected by the analog to digital converter, and responsive to generate a notification signal if the detected first voltage deviates beyond a threshold from about half of the test voltage; and wherein the processor is receptive of a signal representative of the second voltage detected by the analog to digital converter, and responsive to generate a notification signal if the detected second voltage deviates beyond a threshold from about half of the test voltage.

11. The fault detector apparatus of claim 10, wherein:

the test voltage is one of 3.3 and 5.0 volts.

12. A fault detector apparatus for a printer having an impact print head with a plurality of electromagnetic coils and a thermal print head with a plurality of heating elements, the apparatus comprising:

a test circuit in signal communication with the impact print head and the thermal print head to test the plurality of electromagnetic coils and the plurality of heating elements, the test circuit comprising:

a test power supply for generating a test voltage;

a first resistor in series connection between the test power supply and the plurality of electromagnetic coils;

a second resistor, the first resistor and the second resistor in series connection with the test power supply and the plurality of heating elements; and an analog to digital converter in signal communication with the second resistor;

wherein in response to a flow of current from the test power supply through the first resistor and one of the plurality of electromagnetic coils, the analog to digital converter detects a first voltage; and wherein in response to a flow of current from the test power supply through the first and second resistors and one of the plurality of heating elements, the analog to digital converter detects a second voltage;

wherein in response to a flow of current through the one electromagnetic coil operating in accordance with an acceptable operational characteristic, the first voltage is described by:

$$\frac{res116}{res116 + element1}(v66); \text{ and}$$

wherein in response to a flow of current through the one heating element operating in accordance with an acceptable operational characteristic, the second voltage is described by:

$$\frac{res116 + res1322}{res116 + res132 + element2}(v66)$$

where:

v66 represents the test voltage;

res116 represents a resistance of the first resistor;

res132 represents a resistance of the second resistor;

element1 represents a resistance of the properly operating electromagnetic coil; and element2 represents a resistance of the properly operating heating element.

13. The fault detector apparatus of claim 12, wherein:

the test voltage is one of 3.3 and 5.0 volts.

* * * * *